United States Patent [19]

Clarke

[11] 4,032,156

[45] June 28, 1977

[54] ASSISTING ORIENTATION OF A MEMBER AS IT MOVES IN A LINEAR PATH

[76] Inventor: Trevor George Clarke, 6 Summercourt Drive, Ravenshead, Nottinghamshire, England

[22] Filed: Nov. 3, 1975

[21] Appl. No.: 628,316

[30] Foreign Application Priority Data

Nov. 1, 1974 United Kingdom ..... 47329/74

[52] U.S. Cl. ..... 273/164

[51] Int. Cl.[2] ..... A63B 53/04

[58] Field of Search ..... 273/77 R, 163 R, 164, 273/167–175, 183 D, 193 R, 194 R, 194 A

[56] References Cited

UNITED STATES PATENTS

| | | | |
|---|---|---|---|
| 1,420,946 | 6/1922 | Rodwell | 273/164 |
| 3,708,172 | 1/1973 | Rango | 273/164 |
| 3,779,398 | 12/1973 | Hunter | 273/164 X |
| 3,880,430 | 4/1975 | McCabe | 273/164 X |
| 3,923,308 | 12/1975 | Mills | 273/183 D |
| D213,118 | 1/1969 | Onaka | 273/164 X |
| D229,622 | 12/1973 | Bartron | 273/164 X |

*Primary Examiner*—Richard J. Apley
*Attorney, Agent, or Firm*—Larson, Taylor and Hinds

[57] ABSTRACT

Means for assisting orientation of a member as it moves in a linear path, especially a golf club head having a flat striking face and substantially flat top and bottom faces, the top face having internal walls defining an aperture in the top face and opening at the bottom face, said walls tapering towards each other so that the aperture reduces in lateral dimensions away from the top face, said walls including two walls inclined to each other in the plane of the top face and also inclined to relatively perpendicular planes.

4 Claims, 4 Drawing Figures

ASSISTING ORIENTATION OF A MEMBER AS IT MOVES IN A LINEAR PATH

This invention is concerned with assisting orientation of a member as it moves in a linear path and provides a member adapted to facilitate visual orientation thereof.

The invention has particular application to a putter as used in golf or associated games. Putters are usually provided with the ball-striking head offset from the shaft and in addition to the judgement required in visually aligning a ball with a hole, it is also necessary to ensure that the striking face of the head, which strikes the ball, does so with the face perpendicular to an imaginary line through the ball and the hole. If the shaft is twisted, so that, at the moment of impact, the striking face of the head is obliquely inclined to the imaginary line, then the ball will be struck at an oblique angle to the line and will miss the hole. The present invention, when applied to such a putter, facilitates maintenance of the striking face perpendicular to the imaginary line as the putter head is moved along the line to strike the ball.

The present invention provides means for assisting a member to be moved along a predetermined path comprising associating with the member two adjacent walls which are relatively inclined in a horizontal plane and are additionally inclined to a vertical plane as viewed from above the member.

Preferably, the walls are provided with differently coloured bands, each band extending along both walls in a horizontal plane.

The two walls may be defining walls of a recess or aperture in an upper face of the member and conveniently the aperture is in the form of a rectangle, rhombus or cross.

The invention also resides in a golf club, particularly a putter, having a striking face and an upper face provided with an aperture which reduces in lateral dimensions away from the upper face, the defining walls of the aperture including two adjacent walls inclined relative to each other in the plane of the upper face, the walls also being inclined to relatively perpendicular planes. The aperture may be formed as explained above.

Reference will now be made to the accompanying drawings, wherein:-

Figure 1:
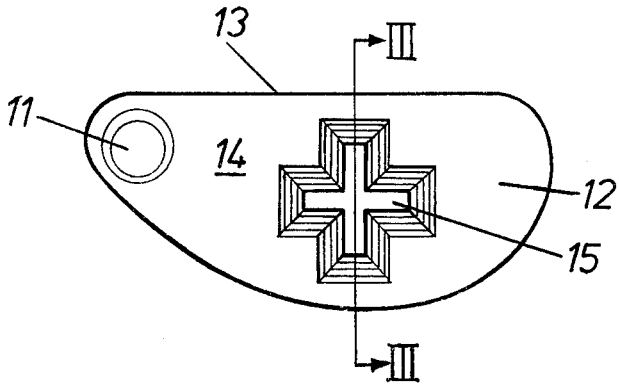
FIG. 1 is a plan view of a putter.
Figure 3:
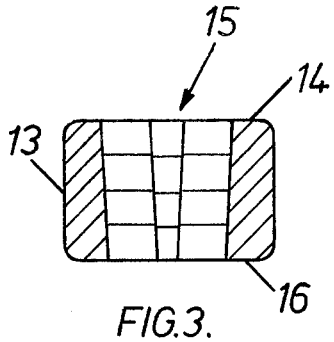
FIG. 3 is a sectional view on the line 3-3 of FIG. 1.
Figure 2:
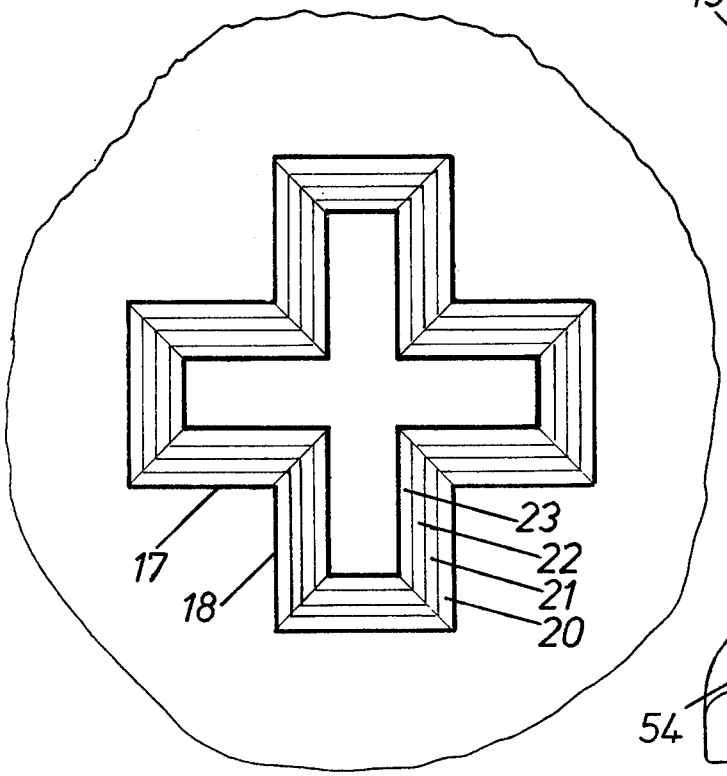
FIG. 2 is an enlargement of a part of the view of FIG. 1.

Referring to the FIGS. 1 to 3, the putter shown comprises a shaft 11 and a body 12, the body being, for example, of solid metal and being provided with a flat, striking face 13 and a substantially flat top face 14, and a substantially flat bottom face 16.

The top face 14 is provided with an aperture 15 which extends completely through the body to open at the bottom face 16. The aperture is in the form of a cross as seen in plan and is defined by walls which taper away from the top face 14 (as shown in FIG. 3) with a reduction in lateral dimensions of the aperture. Each wall, such as 17, of the aperture is, therefore, inclined to a vertical plane through the body in the position of use of the putter.

The cross form is made up from several pairs of adjacent walls, such as 17, 18, which are relatively inclined in a horizontal plane, parallel to the planes of the top and bottom faces 14, 16, an an angle of 90 °. The cross is arranged with one limb extending perpendicularly to the striking face 13.

The walls are provided with four bands 20 to 23, which extend completely around the aperture and are positioned one above the other. The bands are, for example, all differently coloured, proposed colours being white, pale blue, dark blue and red respectively for the bands 20 to 23.

In use, the putter is used in conventional manner, the putter being visually aligned with the ball and the hole, with the striking face 13 as close as possible to being perpendicular to the desired line of movement of the putter. For accurate orientation of the striking face, the putter is moved in the direction of swing along said line, whilst the aperture 15 is viewed. If the orientation is correct, all of the bands will remain visible and appear to be of constant widtth, whereas if the orientation is wrong, the bands will appear to vary in width or even possibly disappear. in the latter case, adjustment of the orientation of the putter is required until the apparent constant band width is attained.

It is envisaged that the aperture may be of different shape in plan, such as a square, or rectangle or a rhombus. In these cases, it is envisaged that two apices of the aperture may be arranged on a straight line, which is perpendicular to the striking face.

Figure 4:
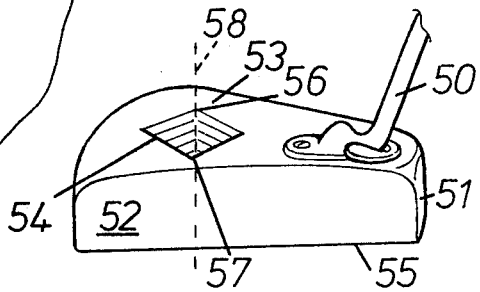
FIG. 4 is a perspective view of a modified putter.

Referring to FIG. 4, a modified putter is shown having a shaft 50 and a body 51. The putter has a striking face 52 and a top face 53 provided with an aperture 54 which is tapered and opens at the bottom face 55. In this case, the aperture is of rhombus shape with two apices 56, 57 in a vertical plane 58 perpendicular to the striking face 52. The walls of the aperture are provided with differently coloured bands 60, 61, 62 as in the previously described embodiment.

What I claim is:

1. A golf club head having a flat striking face and substantially flat top and bottom faces, the top face having internal walls defining an aperture in the top face and opening at the bottom face, said walls tapering towards each other so that the aperture reduces in lateral dimensions away from the top face, said walls including at least two walls inclined to each other in the plane of the top face and also inclined to relatively perpendicular planes.

2. A golf club head according to claim 1, wherein said two walls are provided with horizontally extending bands, parallel to the top face, the bands being differently coloured.

3. A golf club head according to claim 1, wherein the walls defining the aperture outline a rhombus or rectangular shape with two opposite apices lying in a vertical plane perpendicular to the striking face.

4. A golf club head according to claim 1, wherein the walls defining the aperture outline a cruciform.

* * * * *